US008806668B2

(12) United States Patent
Lin et al.

(10) Patent No.: US 8,806,668 B2
(45) Date of Patent: Aug. 19, 2014

(54) CLEANER STRUCTURE FOR TOILET TANK

(75) Inventors: Ching-Bin Lin, New Taipei (TW); Chien-Chia Wang, New Taipei (TW); Chia-Ying Yuan, New Taipei (TW)

(73) Assignee: Tamkang University, New Taipei (TW)

( * ) Notice: Subject to any disclaimer, the term of this patent is extended or adjusted under 35 U.S.C. 154(b) by 427 days.

(21) Appl. No.: 13/173,318

(22) Filed: Jun. 30, 2011

(65) Prior Publication Data

US 2012/0210504 A1 Aug. 23, 2012

(30) Foreign Application Priority Data

Feb. 17, 2011 (TW) ..... 100105316 A

(51) Int. Cl.
*E03D 9/02* (2006.01)
*E03D 9/03* (2006.01)

(52) U.S. Cl.
CPC . *E03D 9/02* (2013.01); *E03D 9/038* (2013.01)
USPC ..... 4/227.1

(58) Field of Classification Search
USPC ..... 4/227.1, 227.4; 422/265, 276–277; 210/121, 123
See application file for complete search history.

(56) References Cited

U.S. PATENT DOCUMENTS

| | | | | | |
|---|---|---|---|---|---|
| 429,384 | A * | 6/1890 | Manwaring | 422/275 |
| 1,002,974 | A * | 9/1911 | Dunkley | 4/227.2 |
| 3,837,017 | A * | 9/1974 | McDuffee | 4/227.1 |
| 4,296,503 | A * | 10/1981 | Leardi | 4/227.2 |
| 4,365,362 | A * | 12/1982 | Corey | 4/227.1 |
| 4,370,763 | A * | 2/1983 | Dolan | 4/227.2 |
| 4,512,041 | A * | 4/1985 | Tsai | 4/227.2 |
| 4,534,070 | A * | 8/1985 | Hauptmann et al. | 4/227.1 |
| 4,692,314 | A * | 9/1987 | Etani | 422/265 |
| 5,181,281 | A * | 1/1993 | Jang | 4/227.2 |
| 6,374,426 | B1 * | 4/2002 | Falchieri | 4/227.2 |
| 7,704,467 | B2 * | 4/2010 | Hodgetts et al. | 422/265 |
| 2008/0217258 | A1 * | 9/2008 | Buchan | 210/747 |

* cited by examiner

*Primary Examiner* — Huyen Le
*Assistant Examiner* — Janie Christiansen
(74) *Attorney, Agent, or Firm* — Kirton McConkie; Evan R. Witt

(57) ABSTRACT

A cleaner structure includes a main body, a forced element and an elastic element. The main body includes a first casing, a floating element, a second casing, first perforations and second perforations. The floating element is disposed within the first casing. The second casing is connected with the first casing for storing a cleaning agent. The elastic element is connected with the first casing and the forced element. During the water level of the liquid inside the toilet tank is changed from a low level to a high level, the second casing is at least partially immersed in the liquid, so that the cleaning agent is released to the liquid.

12 Claims, 6 Drawing Sheets

CLEANER STRUCTURE FOR TOILET TANK

FIELD OF THE INVENTION

The present invention relates to a cleaner structure, and more particularly to a cleaner structure for a toilet tank.

BACKGROUND OF THE INVENTION

As known, there are many types of cleaners used in the toilet tank. One of the cleaners is a throw-in type cleaner containing a solid cleaning tablet. The solid cleaning tablet may be thrown into the water tank of the toilet. After the solid cleaning tablet is naturally dissolved and mixed with the water in the water tank, an aqueous cleaning agent is produced. After the toilet has been used, the user may flush the toilet with the aqueous cleaning agent so as to maintain the clean and fragrant condition of the toilet.

However, the use of the throw-in type cleaner containing the solid cleaning tablet has several drawbacks. For example, due to sustained dissolution of the solid cleaning tablet, if the solid cleaning tablet is immersed in the water of the toilet tank for a long time period, the aqueous cleaning agent discharged from the toilet becomes more and more concentrated. If the concentration of the aqueous cleaning agent exceeds the requisite concentration, this results in waste of the solid cleaning tablet and shortens the use cycle of the solid cleaning tablet. Since the user needs to frequently replenish the solid cleaning tablet, the operating cost is very high. On the other hand, if the toilet is frequently used in a short time, the solid cleaning tablet is insufficiently dissolved and thus the concentration of the aqueous cleaning agent discharged from the toilet is very low. Under this circumstance, the cleaning efficacy of the solid cleaning tablet is unsatisfied.

From the above discussions, the use of the throw-in type cleaner containing the solid cleaning tablet is disadvantageous because it is difficult to maintain a proper concentration of the aqueous cleaning agent. The sustained dissolution of the solid cleaning table may result in a too high concentration of the aqueous cleaning agent. In other words, the frequency of using the toilet is an important factor influencing the concentration of the aqueous cleaning agent. If the concentration of the aqueous cleaning agent is too high, the use cycle of the solid cleaning tablet is shortened and the user needs to frequently replenish the solid cleaning tablet. On the other hand, if the concentration of the aqueous cleaning agent is too low, the cleaning efficacy is unsatisfied.

Therefore, there is a need of providing a cleaner structure for a toilet tank in order to maintain a proper concentration of the aqueous cleaning agent.

SUMMARY OF THE INVENTION

The present invention provides a cleaner structure with a main body, a forced element and an elastic element. By changing the relative locations of the main body, the forced element and the elastic element according to a water level of a liquid inside the toilet tank, the cleaning agent stored within the cleaner structure is selectively released so as to maintain a proper concentration of the aqueous cleaning agent.

In accordance with an aspect of the present invention, there is provided a cleaner structure for a toilet tank. The cleaner structure includes a main body, a forced element and an elastic element. The main body includes a first casing, a floating element, a second casing, a plurality of first perforations and a plurality of second perforations. The floating element is disposed within the first casing. The second casing is connected with the first casing for storing a cleaning agent. The first perforations are asymmetrically located at the first casing. The second perforations are located at the second casing. The forced element is substantially an arc-shaped film structure. The elastic element is connected with the first casing and the forced element. The relative locations of the main body, the forced element and the elastic element are changed with a water level of a liquid inside the toilet tank, so that the second casing is selectively immersed in the liquid or located over the water level. During the water level of the liquid inside the toilet tank is changed from a low level to a high level, the second casing is at least partially immersed in the liquid, so that the cleaning agent is released to the liquid.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
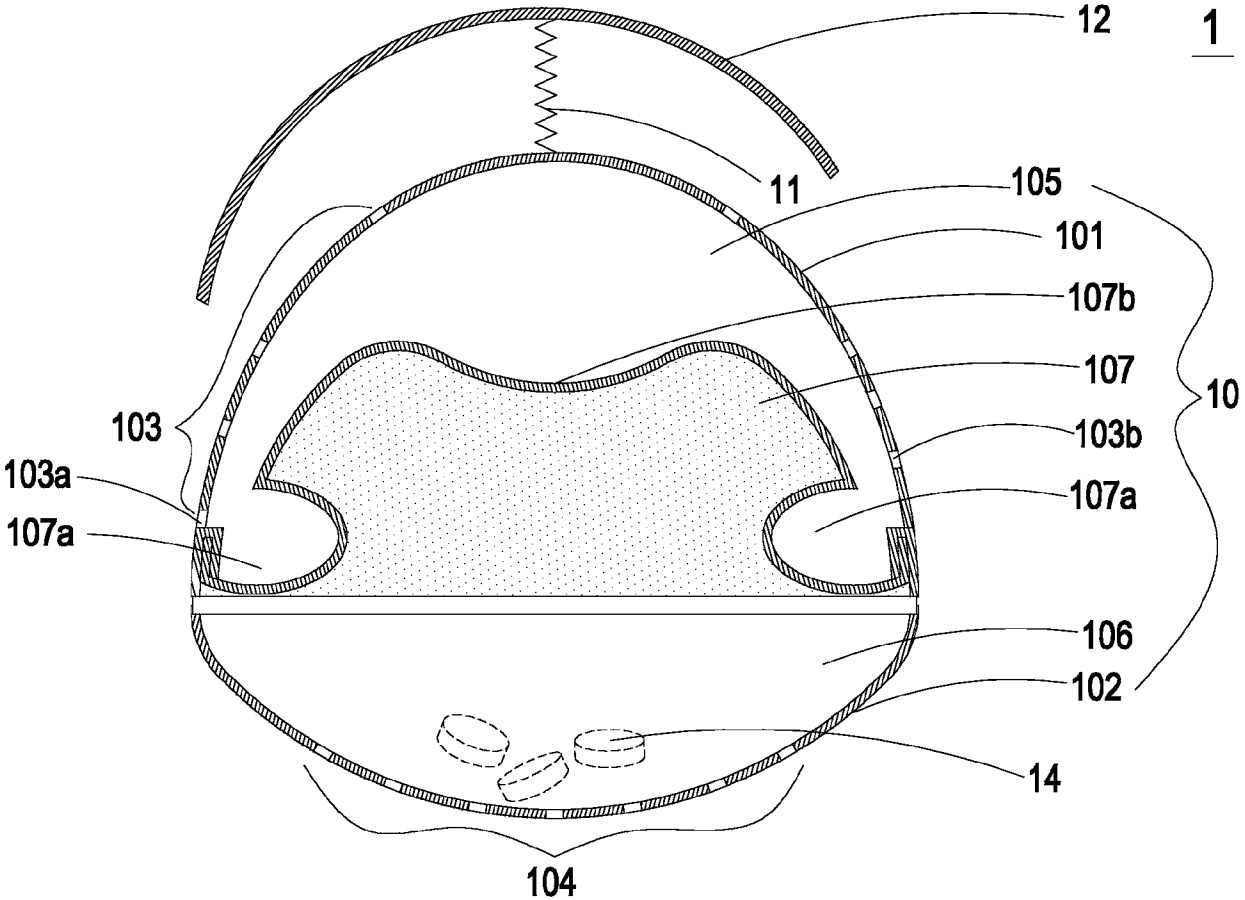
FIG. 1 is a schematic cross-sectional view illustrating a cleaner structure for a toilet tank according to an embodiment of the present invention.

FIG. 1 is a schematic cross-sectional view illustrating a cleaner structure for a toilet tank according to an embodiment of the present invention. The cleaner structure 1 can be applied to the water tank of a toilet. As shown in FIG. 1, the cleaner structure 1 comprises a main body 10, an elastic element 11 and a forced element 12. The main body 10 comprises a first casing 101, a second casing 102, a plurality of first perforations 103 and a plurality of second perforations 104. The first casing 101 and the second casing 102 are connected with each other, thereby collectively defining an egg-shaped structure. The second casing 102 is formed as a blunt end of the egg-shaped structure. These first perforations 103 are asymmetrically located at two opposite sides of the first casing 101. Moreover, at least one of the first perforations 103 at the first side (e.g. the left side) of the first casing 101 is closer to the second casing 102 than any of the first perforations 103 at the second side (e.g. the right side) of the first casing 101. For example, as shown in FIG. 1, the first perforation 103*a* at the left side of the first casing 101 is closer to the second casing 102 than the first perforation 103*b* at the right side of the first casing 101. That is, if the first casing 101 is disposed over the second casing 102, the first perforation 103*a* is located at a level lower than the first perforation 103*b*. These second perforations 104 are located at the second casing 102.

Moreover, the first casing 101 and the second casing 102 are hollow structures with a first receptacle 105 and a second receptacle 106, respectively. The first receptacle 105 is configured to partially accommodate a floating element 107. In this embodiment, the floating element 107 is made of styrofoam material. The second receptacle 106 is configured to accommodate a cleaning agent 14. An example of the cleaning agent 14 includes but is not limited to a cleaning tablet. The floating element 107 is arranged beside the second casing 102. Moreover, the floating element 107 is fixed on the first casing 101 by a fastening means, an adhering means or any other means. Two concave parts 107*a* are formed at two opposite sides of the floating element 107, respectively. In addition, the top surface 107*b* of the floating element 107 is a curvy surface. Preferably, the top surface 107*b* of the floating element 107 is an internally-concaved curvy surface.

Please refer to FIG. 1 again. The cleaner structure 1 further comprises an elastic element 11 and a forced element 12. The forced element 12 is an arc-shaped film structure and connected to a first end of the elastic element 11. A second end of the forced element 12 is connected with the first casing 104. In an embodiment, the first end and the second end of the elastic element 11 are respectively connected with the forced element 12 and the first casing 101 by waterproof glue (not shown). Alternatively, the first end and the second end of the elastic element 11 are respectively connected with and fixed on the forced element 12 and the first casing 101 during the plastic molding process of the forced element 12 and the first casing 101. The forced element 12 is asymmetrically connected with the elastic element 11 for facilitating turning over the cleaner structure 1 within the water tank of the toilet. An example of the elastic element 11 is a spring. The elastic element 11 is made of metallic material (e.g. stainless steel) or plastic material.

FIGS. 2A~2E schematically illustrate the actions of the cleaner structure of FIG. 1 as the water level of the liquid inside the toilet tank is changed.

Figure 2A:
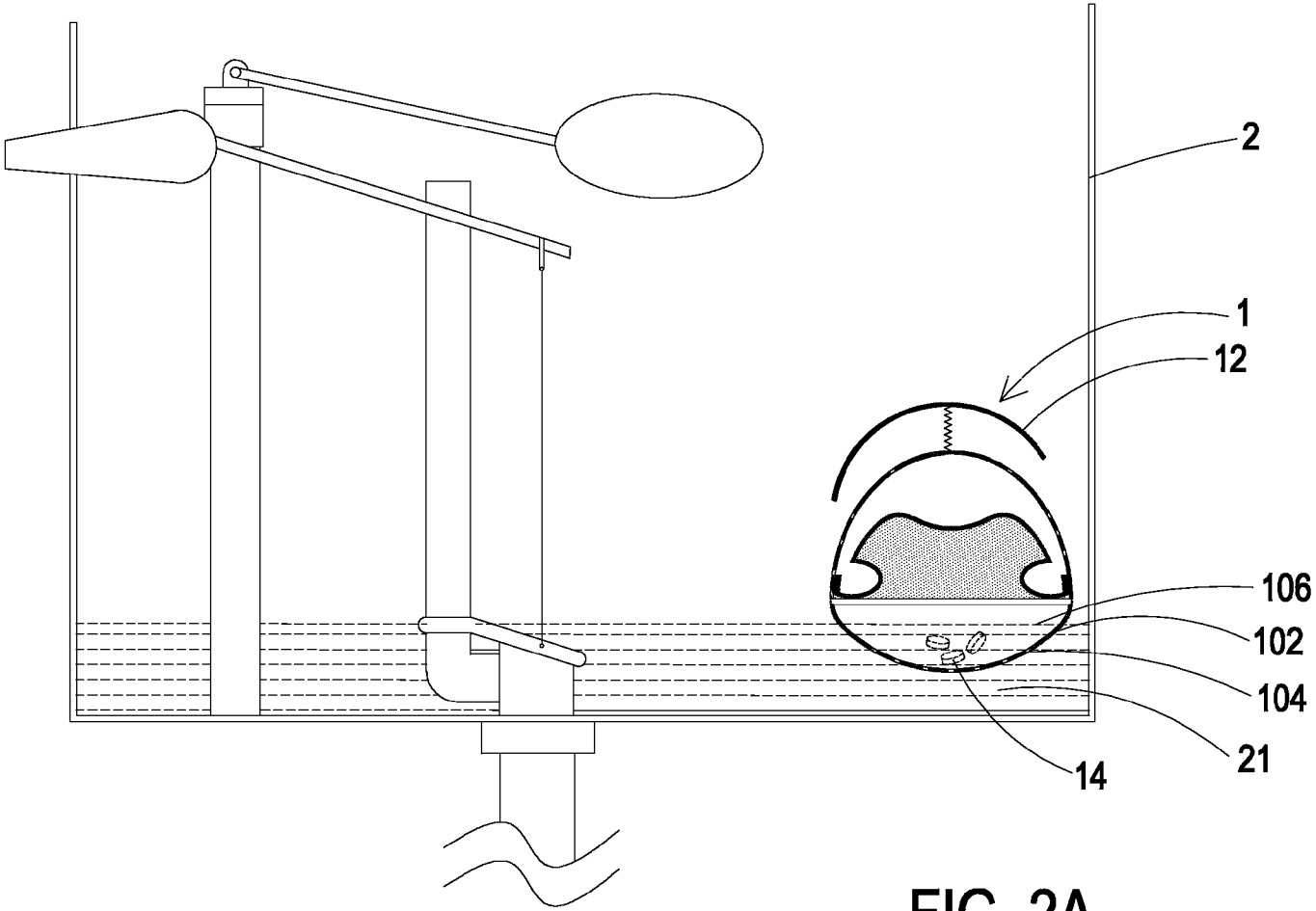
FIGS. 2A~2E schematically illustrate the actions of the cleaner structure of FIG. 1 as the water level of the liquid inside the toilet tank is changed.
Figure 2B:
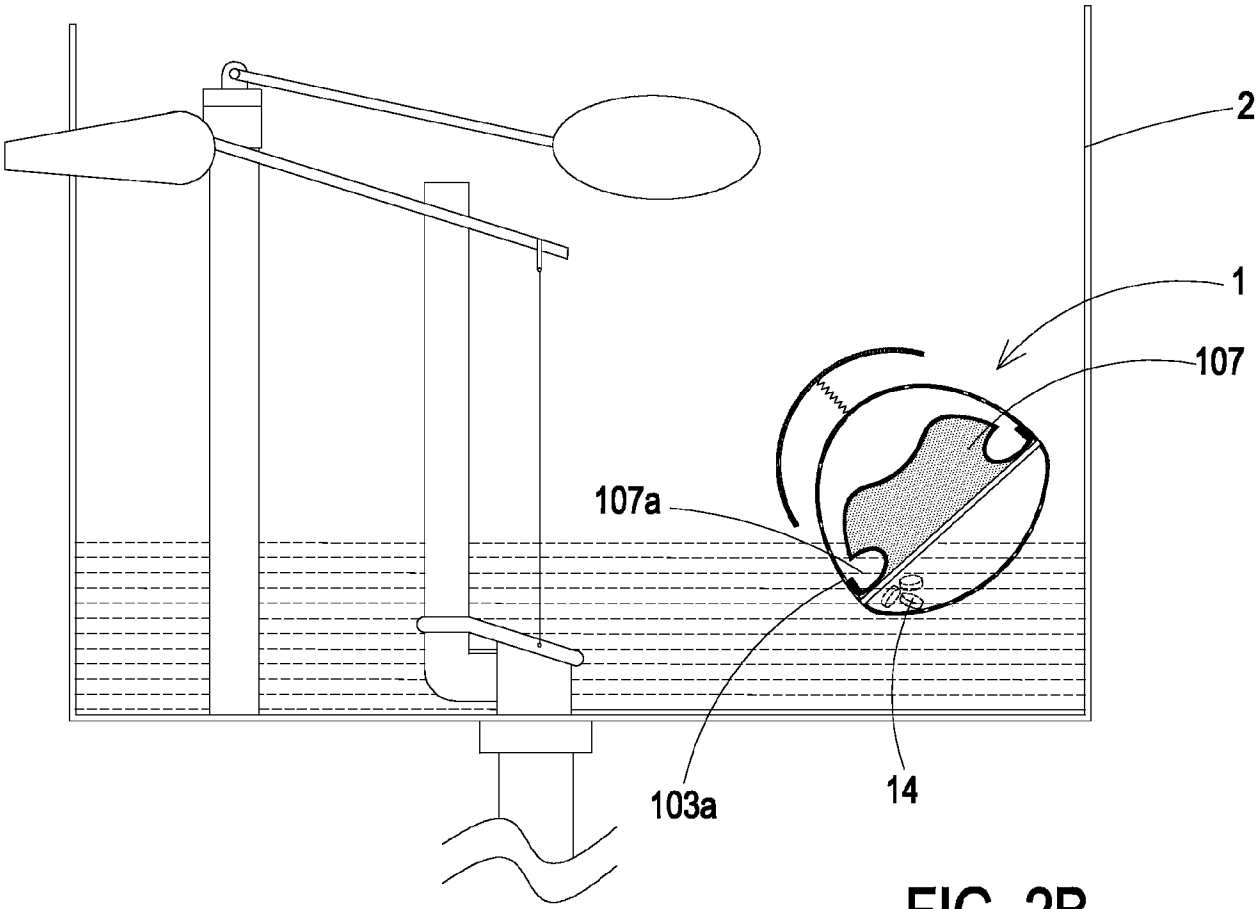
Figure 2C:
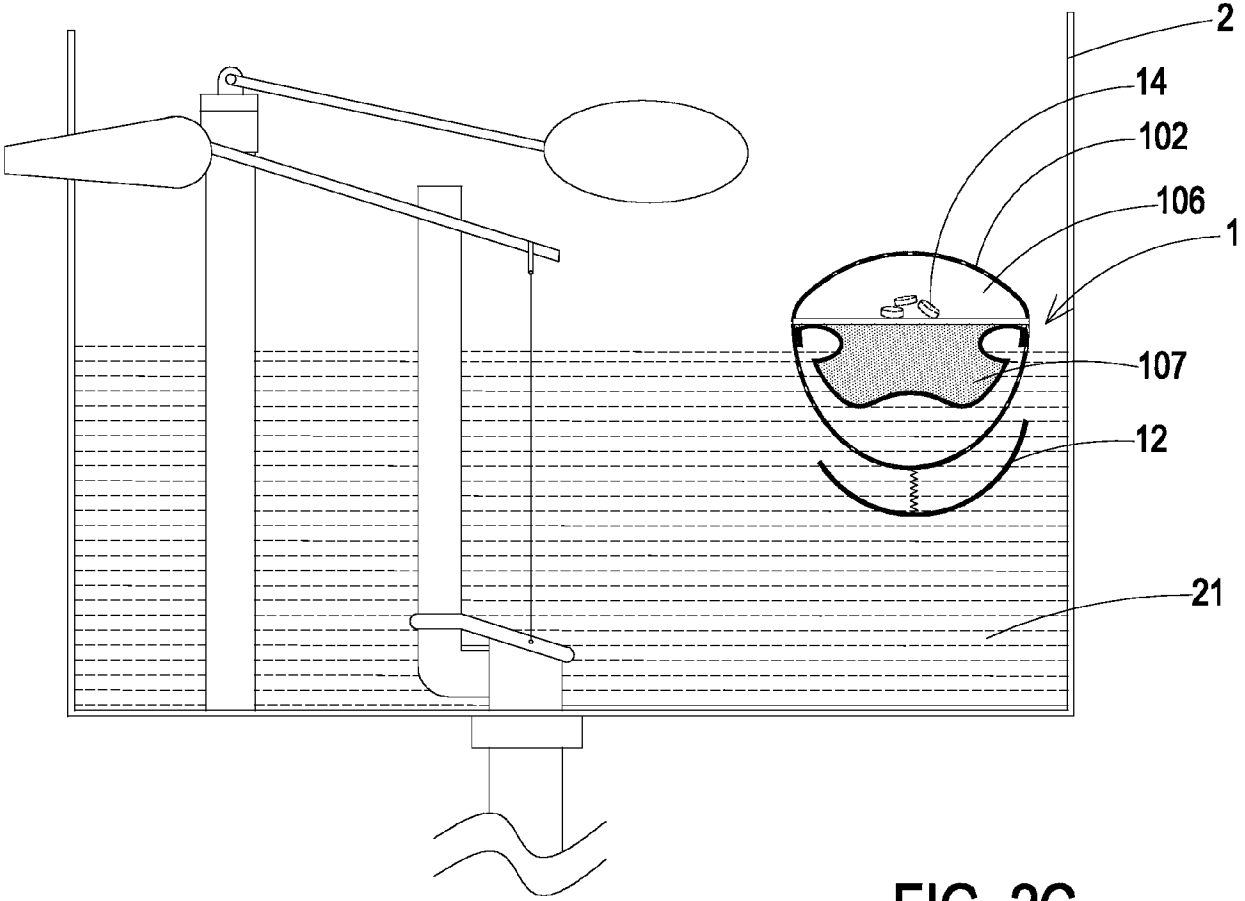
Figure 2D:
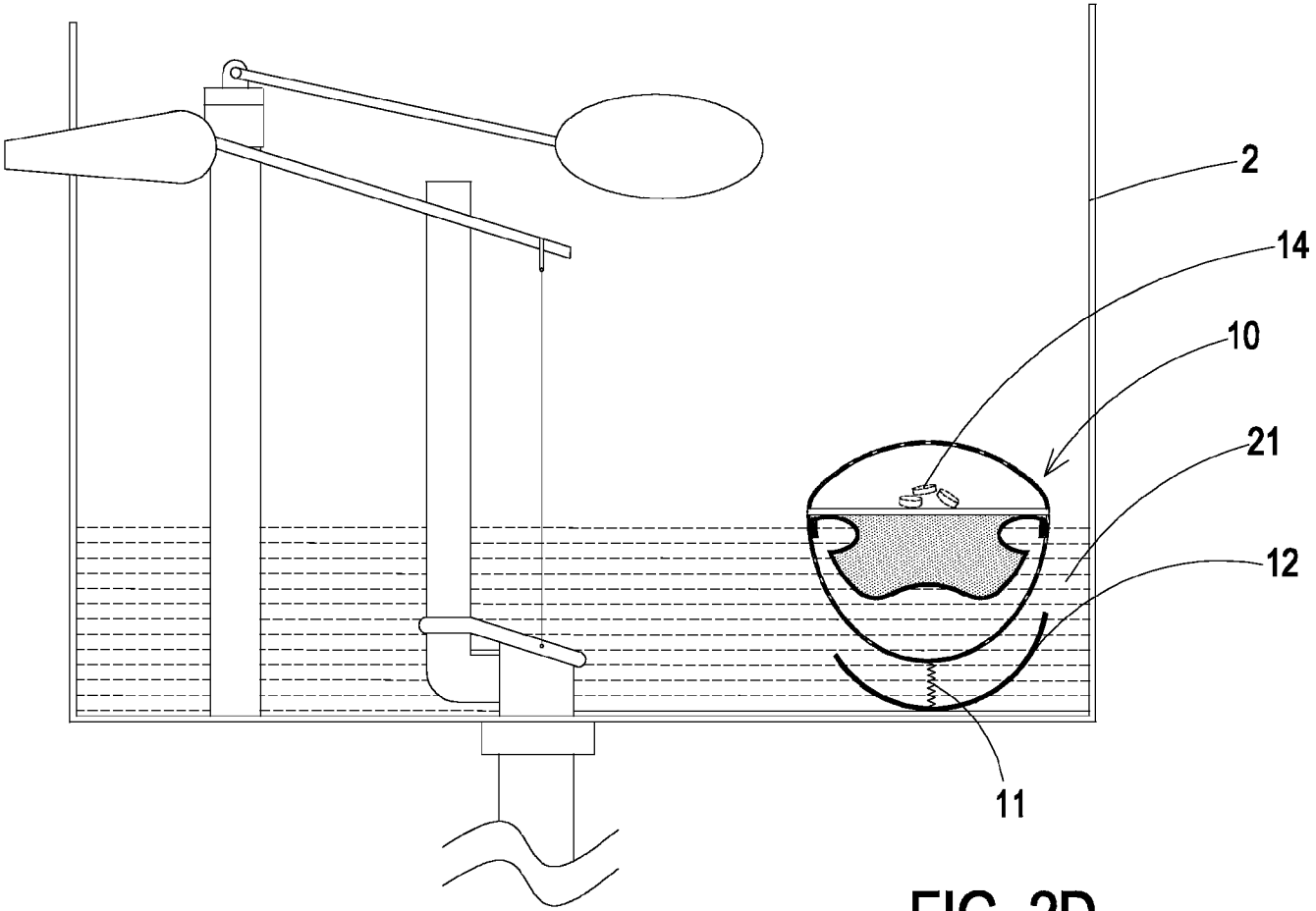

As shown in FIG. 2A, a liquid 21 (e.g. water) is contained in a toilet tank 2. After the toilet is used and the user flushes the toilet, the liquid 21 inside the toilet tank 2 will drop down to the low water level. Consequently, the cleaner structure 1 floats on the water while the forced element 12 is located at the topside. Moreover, since the second casing 102 is immersed in the liquid 21, the liquid 21 can be introduced into the second receptacle 106 through the second perforations 104. The cleaning agent 14 stored within the second receptacle 106 is dissolved by the liquid 21 and released to the liquid 21.

Then, as the water level of the liquid 21 starts rising, the cleaner structure 1 is floated upwardly and the cleaning agent 14 stored within the second receptacle 106 is continuously dissolved by the liquid 21. As the water level of the liquid 21 rises, the liquid 21 continuously fluctuates. Consequently, the liquid 21 is introduced into the concave part 107*a* of the floating element 107 through the first perforation 103*a* which is the closest to the second casing 102. Due to the weight of the liquid 21 accommodated within the concave part 107*a*, the cleaner structure 1 is in a non-equilibrium state. Under this circumstance, the cleaner structure 1 is gradually deflected toward the left side (see FIG. 2B). Then, the cleaner structure 1 is turned over by 180 degrees (see FIG. 2C). Consequently, the cleaner structure 1 floats on the water while the forced element 12 is located at the underside. Moreover, since the second casing 102 is higher than the water level, the cleaning agent 14 stored within the second receptacle 106 is no longer contacted with the liquid 21. Under this circumstance, the cleaning agent 14 stored within the second receptacle 106 is not dissolved by the liquid 21. Since the cleaning agent 14 is not continuously immersed in the liquid 21, the cleaning agent 14 is not excessively released. In other words, the use life of the cleaning agent 14 is prolonged.

Figure 2E:
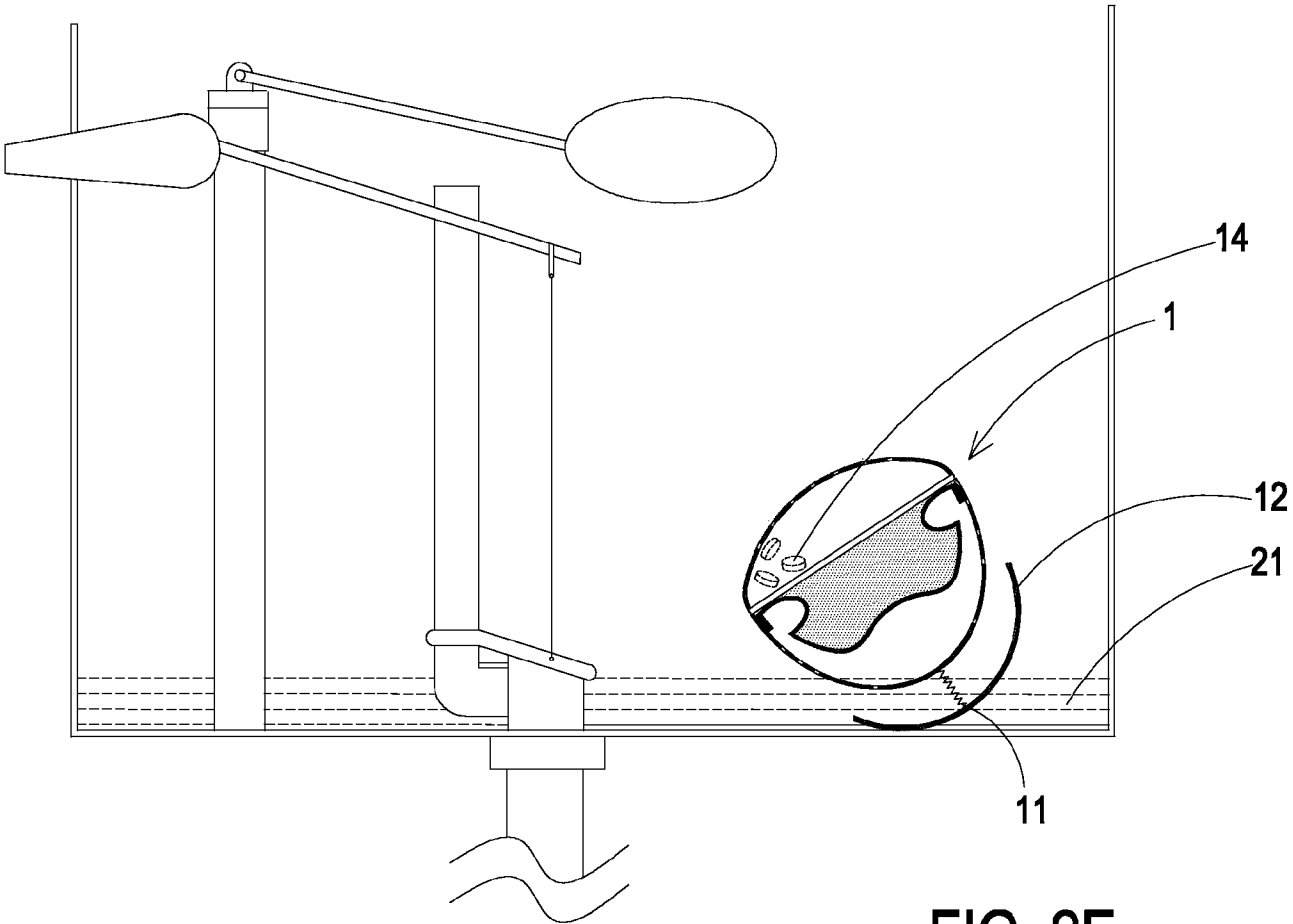

After the toilet is used and the user flushes the toilet again, the water inside the toilet tank 2 will drop down to the low water level again. As the water level of the toilet tank 2 is lowered, the cleaner structure 1 is lowered, and the forced element 12 is firstly contacted with the bottom of the toilet tank 2 (see FIG. 2D). Then, the elastic element 11 is compressed by the main body 10 of the cleaner structure 1. Due to the arc-shaped structure of the forced element 12, the elastic force generated by the elastic element 11 and the fluctuation of the liquid 21, the cleaner structure 1 is unstable and readily rocked. Consequently, the cleaner structure 1 is deflected (see FIG. 2E). Since the forced element 12 is asymmetrically connected with the elastic element 11, the force areas at both sides of the forced element 12 are different. As shown in FIG. 2E, the force area at the right side of the forced element 12 is larger than the force area at the left side of the forced element 12. Since the force acting on the right side of the forced element 12 is larger than the force acting on the left side of the forced element 12, the cleaner structure 1 is deflected toward the left side. As the cleaner structure 1 is deflected toward the left side, the liquid 21 is introduced into the first receptacle 105 through the first perforations 103 again and the center of gravity of the cleaner structure is switched to the second casing 102 again, so that the cleaner structure 1 is turned over. Under this circumstance, the second casing 102 is immersed in the liquid 102 and the cleaning agent 14 is dissolved and released to the liquid 21 (see FIG. 2A).

From the above description, the cleaner structure 1 of the present invention is turned over at the moment when the water level of the liquid 21 inside the toilet tank 2 is switched from the low level to the high level or at the moment when the water level of the liquid 21 inside the toilet tank 2 is switched from the high level to the low level. Moreover, the cleaning agent 14 stored within the second casing 102 is permitted to be dissolved and released during the water level of the liquid 21 inside the toilet tank 2 is switched from the low level to the high level. In a case that the toilet is not flushed, the water level of the liquid 21 inside the toilet tank 2 is at the high level and the second casing 102 is located over the water level. Under this circumstance, the cleaning agent 14 fails to be continuously dissolved. After the toilet is flushed, the water level of the liquid 21 inside the toilet tank 2 is at the low level and the second casing 102 is immersed in the liquid 21. Under this circumstance, the cleaning agent 14 is dissolved and released again. By using the cleaner structure 1 of the present invention, the cleaning agent 14 stored within the second casing 102 is selectively released according to the frequency of flushing the toilet. That is, by using the cleaner structure 1 of the present invention, the cleaning agent 14 can be intermittently released in order to maintain a proper concentration of the cleaning agent 14.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A cleaner structure for a toilet tank, said cleaner structure comprising:

a main body comprising a first casing, a floating element, a second casing, a cleaning agent, a plurality of first perforations and a plurality of second perforations, wherein said floating element is disposed within said first casing, said second casing is connected with said first casing for storing said cleaning agent, said first perforations are asymmetrically located at said first casing, and said second perforations are located at said second casing;

a forced element, which is an arc-shaped sheet structure; and an elastic element connected with said first casing and said forced element, wherein the relative locations of said main body, said forced element and said elastic element are changed with a water level of a liquid inside said toilet tank, so that said cleaner structure is turned over according to said water level of said liquid inside said toilet tank and said second casing is selectively immersed in said liquid or located over said water level, wherein during said water level of said liquid inside said toilet tank is changed from a low level to a high level, said second casing is at least partially immersed in said liquid, so that said cleaning agent is released to said liquid, wherein said first perforations are asymmetrically located at a first side and a second side of said first casing, said first side and said second side of said first casing are opposed to each other, at least one first perforation at said first side of said first casing is closer to said second casing than any of said first perforations at said second side of said first casing, at least one concave part is located at one side of said floating element, and during said water level of said liquid inside said toilet tank is changed from said low level to said high level, said liquid is introduced into said concave part through said at least one first perforation, so that said cleaner structure is deflected toward said first side and gradually turned over until said second casing is located over said water level.

2. The cleaner structure according to claim 1 wherein said first casing is a hollow structure with a first receptacle for accommodating said floating element.

3. The cleaner structure according to claim 1 wherein said second casing is another hollow structure with a second receptacle for storing said cleaning agent.

4. The cleaner structure according to claim 1 wherein said cleaning agent is a cleaning tablet.

5. The cleaner structure according to claim 1 wherein a top side of said floating element is a curvy surface.

6. The cleaner structure according to claim 1 wherein said floating element is made of styrofoam material.

7. The cleaner structure according to claim 1 wherein when said water level of said liquid inside said toilet tank is at said high level or changed from said high level to said low level, said second casing is located over said water level, so that said cleaning agent is not released.

8. The cleaner structure according to claim 7 wherein said forced element is asymmetrically connected with said elastic element.

9. The cleaner structure according to claim 8 wherein when said water level of said liquid inside said toilet tank is at said high level, said second casing is located over said water level and said forced element is immersed in said liquid, wherein as said water level of said liquid inside said toilet tank is gradually decreased, said forced element is contacted with a bottom of said toilet tank and said elastic element is compressed to result in an elastic force, wherein said elastic force is asymmetrically exerted on said forced element, so that said cleaner structure is turned over.

10. The cleaner structure according to claim 1 wherein said elastic element is a spring.

11. The cleaner structure according to claim 1 wherein said elastic element is made of metallic material or plastic material.

12. The cleaner structure according to claim 1 wherein when said second casing is immersed in said liquid, said liquid is introduced into said second receptacle through said second perforations, so that said cleaning agent is released and discharged to said liquid through said second perforations.

* * * * *